US009605333B2

(12) United States Patent
Hori et al.

(10) Patent No.: US 9,605,333 B2
(45) Date of Patent: Mar. 28, 2017

(54) ALUMINUM ALLOY FORGED MATERIAL FOR AUTOMOBILE AND METHOD FOR MANUFACTURING THE SAME

(71) Applicant: Kabushiki Kaisha Kobe Seiko Sho (Kobe Steel, Ltd.), Kobe-shi (JP)

(72) Inventors: Masayuki Hori, Inabe (JP); Yoshiya Inagaki, Inabe (JP); Manabu Nakai, Moka (JP)

(73) Assignee: Kobe Steel, Ltd., Kobe-shi (JP)

( * ) Notice: Subject to any disclaimer, the term of this patent is extended or adjusted under 35 U.S.C. 154(b) by 361 days.

(21) Appl. No.: 14/191,782

(22) Filed: Feb. 27, 2014

(65) Prior Publication Data

US 2014/0290809 A1 Oct. 2, 2014

(30) Foreign Application Priority Data

Mar. 29, 2013 (JP) ..... 2013-074378
Dec. 10, 2013 (JP) ..... 2013-255380

(51) Int. Cl.

| | |
|---|---|
| ***C22F 1/05*** | (2006.01) |
| ***C22C 21/02*** | (2006.01) |
| ***C22C 21/00*** | (2006.01) |
| ***C22F 1/043*** | (2006.01) |
| ***C22C 21/04*** | (2006.01) |
| ***C22C 21/08*** | (2006.01) |
| *C22F 1/04* | (2006.01) |

(52) U.S. Cl.

CPC ..... *C22F 1/043* (2013.01); *C22C 21/00* (2013.01); *C22C 21/02* (2013.01); *C22C 21/04* (2013.01); *C22C 21/08* (2013.01); *C22F 1/05* (2013.01)

(58) Field of Classification Search

CPC ..... C22C 21/00–21/18; C22F 1/04–1/057
See application file for complete search history.

(56) References Cited

U.S. PATENT DOCUMENTS

| | | | |
|---|---|---|---|
| 5,240,519 | A | 8/1993 | Kamio et al. |
| 6,678,574 | B2 | 1/2004 | Fujii et al. |
| 8,152,940 | B2 | 4/2012 | Nakai et al. |
| 8,372,220 | B2 | 2/2013 | Inagaki et al. |
| 2009/0000705 | A1 | 1/2009 | Nakai et al. |

(Continued)

FOREIGN PATENT DOCUMENTS

| | | | |
|---|---|---|---|
| CN | 1071970 | A | 5/1993 |
| CN | 101365818 | A | 2/2009 |

(Continued)

OTHER PUBLICATIONS

The Extended European Search Report issued Oct. 6, 2014, in Application No. / U.S. Pat. No. 14000840.0-1362.

*Primary Examiner* — Lois Zheng
(74) *Attorney, Agent, or Firm* — Oblon, McClelland, Maier & Neustadt, L.L.P.

(57) ABSTRACT

The aluminum alloy forged material for an automobile according to the present invention is composed of an aluminum alloy including Si: 0.7-1.5 mass %, Fe: 0.5 mass % or less, Cu: 0.1-0.6 mass %, Mg: 0.6-1.2 mass %, Ti: 0.01-0.1 mass % and Mn: 0.25-1.0 mass %, further including at least one element selected from Cr: 0.1-0.4 mass % and Zr: 0.01-0.2 mass %, restricting Zn: 0.05 mass % or less, and a hydrogen amount: 0.25 ml/100 g-Al or less, with the remainder being Al and inevitable impurities, wherein the aluminum alloy forged material has an area ratio the <111> texture of 60% or more in a cross section parallel to the extrusion direction.

8 Claims, 5 Drawing Sheets

(56) References Cited

U.S. PATENT DOCUMENTS

| | | | |
|---|---|---|---|
| 2010/0089503 | A1 | 4/2010 | Inagaki et al. |
| 2011/0221151 | A1 | 9/2011 | Sakamoto et al. |
| 2013/0032255 | A1 | 2/2013 | Hori et al. |
| 2013/0239412 | A1 | 9/2013 | Sakamoto et al. |
| 2013/0255841 | A1 | 10/2013 | Hori et al. |
| 2013/0255842 | A1 | 10/2013 | Hori et al. |

FOREIGN PATENT DOCUMENTS

| | | | |
|---|---|---|---|
| CN | 102812142 | A | 12/2012 |
| DE | 10 2013 018 744 | A1 | 8/2014 |
| EP | 2 554 698 | A1 | 2/2013 |
| EP | 2 644 725 | A2 | 10/2013 |
| EP | 2 644 725 | A3 | 10/2013 |
| EP | 2 644 727 | A2 | 10/2013 |
| EP | 2 644 727 | A3 | 10/2013 |
| EP | 2 644 727 | A8 | 10/2013 |
| JP | 5-59477 | A | 3/1993 |
| JP | 2004-43907 | | 2/2004 |
| JP | 2007-177308 | | 7/2007 |
| WO | WO 2011/122263 | A1 | 10/2011 |

ALUMINUM ALLOY FORGED MATERIAL FOR AUTOMOBILE AND METHOD FOR MANUFACTURING THE SAME

BACKGROUND OF THE INVENTION

Field of the Invention

The present invention relates to an aluminum alloy forged material suitably used for an automobile, and a method for manufacturing the same.

Description of the Related Art

There is a prior art invention regarding an aluminum alloy forged material for a chassis member of an automobile (an aluminum alloy forged material used for an automobile), such as that described in Japanese Patent No. 3766357. Disclosed in the patent literature is an aluminum alloy forged material including Mg: 0.6-1.8 mass %, Si: 0.8-1.8 mass %, Cu: 0.2-1.0 mass %, mass ratio of Si/Mg is 1 or more, further including one or more elements of Mn: 0.1-0.6 mass %, Cr: 0.1-0.2 mass % and Zr: 0.1-0.2 mass %, and the remainder being Al and inevitable impurities. The aluminum alloy forged material of the composition has a thickness of the thinnest portion of 30 mm or less, electrical conductivity measured at the surface of 41.0-42.5 IACS % after artificial age hardening treatment, and 0.2% proof stress of 350 MPa or more.

Although the 0.2% proof stress of the aluminum alloy forged material disclosed in Japanese Patent No. 3766357 is defined 350 MPa or more, the largest value is about 370 MPa as demonstrated in its Examples. Furthermore, regarding mechanical properties, its tensile strength is less than 400 MPa while the forged material has an excellent elongation.

In recent years, increasing requirements of further weight reduction have been raised for aluminum alloy forged materials for automobiles. To satisfy the requirements, high mechanical strength is essential for the aluminum alloy forged materials. It was difficult, however, for the invention disclosed in Japanese Patent No. 3766357 to realize the high strength to implement the tensile strength, 0.2% proof strength, and elongation at sufficiently high level.

SUMMARY OF THE INVENTION

The present invention has been developed in view of such circumstance, and its object is to provide an aluminum alloy forged material for an automobile excellent in tensile strength, and a method for manufacturing the same.

The aluminum alloy forged material for an automobile of an embodiment of the present invention to solve the problems is manufactured by a process including extrusion and forging steps. The aluminum alloy forged material is composed of an aluminum alloy including Si: 0.7-1.5 mass %, Fe: 0.5 mass % or less, Cu: 0.1-0.6 mass %, Mg: 0.6-1.2 mass %, Ti: 0.01-0.1 mass % and Mn: 0.25-1.0 mass %, further including at least one element selected from Cr: 0.1-0.4 mass % and Zr: 0.01-0.2 mass %, restricting Zn: 0.05 mass % or less, and a hydrogen amount: 0.25 ml/100 g-Al or less, with the remainder being Al and inevitable impurities, wherein the aluminum alloy forged material has an area ratio the <111> texture of 60% or more in a cross section parallel to the extrusion direction, a tensile strength of 400 MPa or more, and elongation of 10.0% or more.

As described above, by controlling the composition of the aluminum alloy to an appropriate range and the area ratio of <111> texture in a cross section parallel to the extrusion direction to a predetermined value or more, it is possible to make the aluminum alloy forged material for an automobile possess the tensile strength, 0.2% proof stress, and elongation of high level. In other words, the aluminum alloy forged material for an automobile of high strength can be realized.

For the aluminum alloy forged material for an automobile according to the present invention, the region where the recrystallized grains exist (depth of recrystallization) is preferably 5 mm or less as measured from the surface of the forged material.

As the tensile strength is remarkably lowered in recrystallized structure, tensile strength of the product itself may be secured by defining the region where recrystallized grains exist in this manner.

Also, the method for manufacturing the aluminum alloy forged material for an automobile in relation with an embodiment of the present invention is a method to manufacture a forged material which is prepared from an ingot by casting an aluminum alloy composed of an aluminum alloy including Si: 0.7-1.5 mass %, Fe: 0.5 mass % or less, Cu: 0.1-0.6 mass %, Mg: 0.6-1.2 mass %, Ti: 0.01-0.1 mass % and Mn: 0.25-1.0 mass %, further including at least one element selected from Cr: 0.1-0.4 mass % and Zr: 0.01-0.2 mass %, restricting Zn: 0.05 mass % or less, and a hydrogen amount: 0.25 ml/100 g-Al or less, the remainder being Al and inevitable impurities. The method for manufacturing the forged material for an automobile includes, in the following order, a homogenizing heat treatment step of subjecting the ingot to homogenizing heat treatment at 450-560° C. for 3-12 hours, and to cooling to 300° C. or below at a rate of 0.5° C./min or more, a first heating step of subjecting the ingot having been subjected to the homogenizing heat treatment to heating at 450-540° C., a extrusion step of subjecting the ingot having been subjected to the first heating to extrusion at extrusion temperature of 450-540° C., extrusion ratio of 6-25, and extrusion rate of 1-15 m/minute, a second heating step of subjecting the extrusion product having been subjected to the extrusion to heating at 500-560° C. for 0.75 hour or more, a forging step of subjecting the work having been subjected to the heating to forging at 450-560° C. of the forging start temperature and 420° C. or above of the forging finish temperature to obtain a forged material of a predetermined shape with an maximum equivalent plastic strain of 3 or less, a solution heat treatment step of subjecting the forged material to solution heat treatment at 480-560° C. for 2-8 hours, a quenching step of subjecting the forged material having been subjected to the solution heat treatment to quenching at 70° C. or below, and an artificial aging treatment step of subjecting the forged material having been quenched to artificial aging treatment at 140-200° C. for 3-12 hours.

The area ratio of <111> texture of 60% can be secured in the aluminum alloy due to the appropriate alloy composition and manufacturing conditions. An aluminum alloy forged material of enhanced tensile strength can be manufactured accordingly.

According to the method for manufacturing the aluminum alloy forged material for an automobile in relation with the present invention, the maximum equivalent plastic strain is preferable controlled to 1.5 or less.

An aluminum alloy forged material of further enhanced tensile strength can be manufactured due to the more suitable manufacturing conditions.

The aluminum alloy forged material according to the present invention can realize an excellent tensile strength such as 0.2% proof stress of 380 MPa by controlling the aluminum alloy composition in a suitable range and the area ratio of <111> texture in a cross section parallel to the extrusion direction.

The method for manufacturing the aluminum alloy forged material for an automobile according to the present invention can realize an excellent tensile strength such as 0.2% proof stress of 380 MPa by controlling the area ratio of <111> texture at predetermined value or more in the extrusion step and maintaining the metal texture in the subsequent steps.

BRIEF DESCRIPTION OF THE DRAWINGS

FIG. 5A is a perspective view of the forged material. FIG. 5B is an enlarged view of part A in FIG. 5A. FIG. 5C is an enlarged view of part B in FIG. 5A.

DESCRIPTION OF THE PREFERRED EMBODIMENTS

Figure 1:
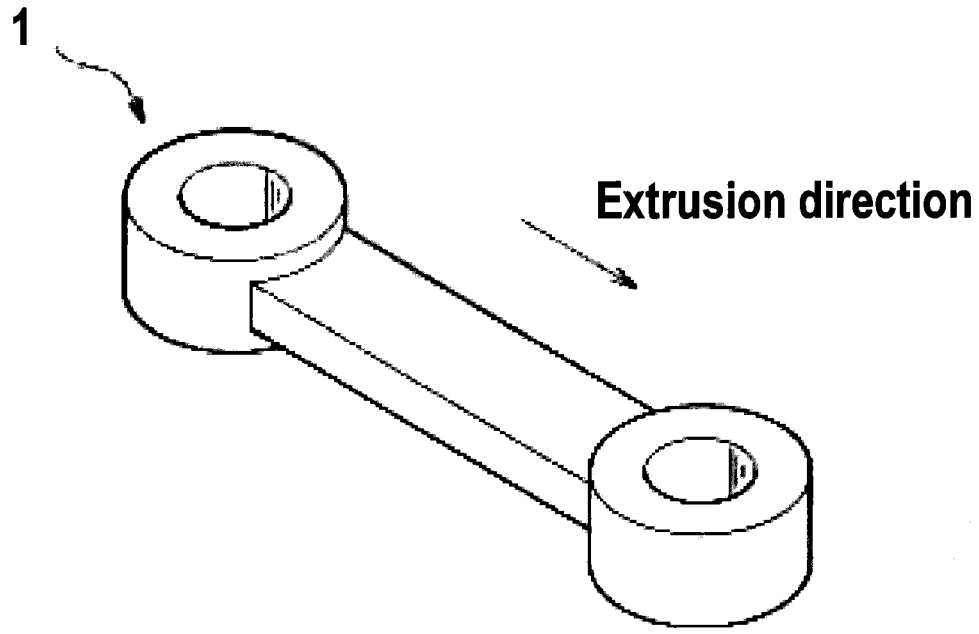
FIG. 1 is a perspective view indicating an example of the aluminum alloy forged material for an automobile in relation with an embodiment according to the present invention.
Figure 2:
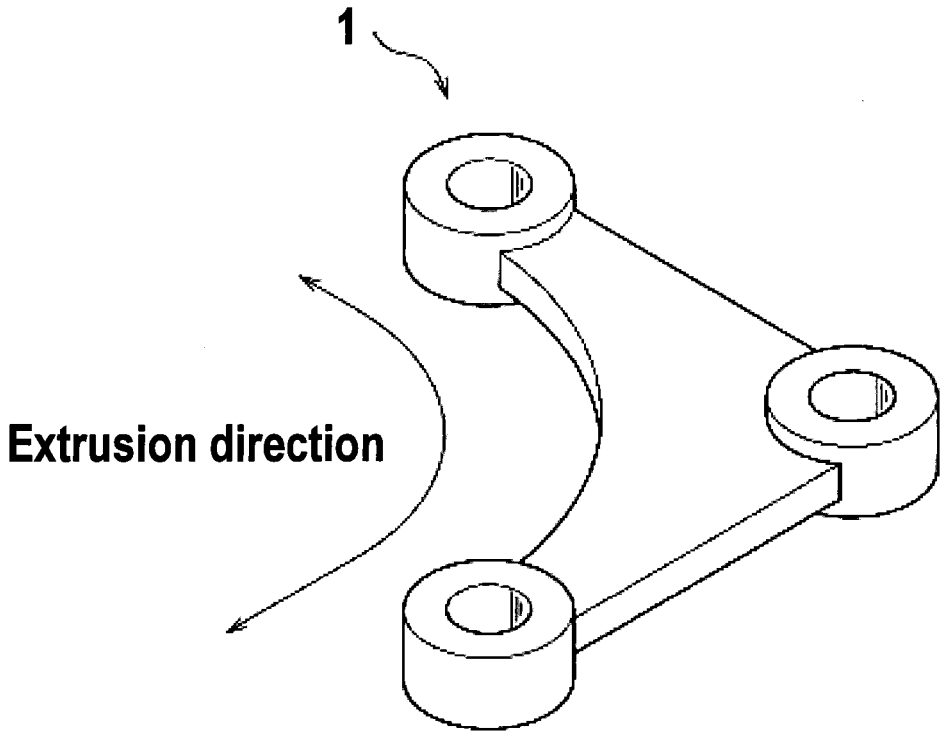
FIG. 2 is a perspective view indicating another example of the aluminum alloy forged material for an automobile in relation with an embodiment according to the present invention.

Hereinafter, the aluminum alloy forged material for an automobile and the method for manufacturing the same in relation with the present invention are described in detail by referring to the figures.

(Aluminum Alloy Forged Material for an Automobile)

The aluminum alloy forged material for an automobile according to the present invention (simply referred to "forged material A" hereinafter) is manufactured by way of extrusion and forging steps. Its use is not limited to an automobile. It is applicable to underbody members of transportation such as, for example, a train, a motorcycle, and an aircraft. Moreover, the application is not limited to underbody members. It is applicable as structural materials (structural members) other than underbody members.

The forged material A according to the present embodiment is comprising an aluminum alloy including Si: 0.7-1.5 mass %, Fe: 0.5 mass % or less, Cu: 0.1-0.6 mass %, Mg: 0.6-1.2 mass %, Ti: 0.01-0.1 mass % and Mn: 0.25-1.0 mass %, further including at least one element selected from Cr: 0.1-0.4 mass % and Zr: 0.01-0.2 mass %, restricting Zn: 0.05 mass % or less, and a hydrogen amount: 0.25 ml/100 g-Al or less, with the remainder being Al and inevitable impurities. wherein the aluminum alloy forged material has an area ratio the <111> texture of 60% or more in a cross section parallel to the extrusion direction, a tensile strength of 400 MPa or more, and elongation of 10.0% or more. Moreover, the metallographic structure, occasionally simply referred as texture, of the forged material A comprises of the area ratio of the <111> texture is 60% or more in a cross section parallel to the extrusion direction, the tensile strength of 400 MPa or more, and the elongation is 10.0% or more.

Each element included in the aluminum alloy of the present embodiment is explained as follows.

(Si: 0.7-1.5 Mass %)

Si is combined with Mg to form $Mg_2Si$ (β' phase) which precipitates during the artificial ageing treatment. The precipitation of $Mg_2Si$ crystals contributes to increasing the strength (0.2% proof stress) of the aluminum alloy forged material which is a final product to be used. When the Si content is less than 0.7 mass %, sufficiently high mechanical strength such as for example tensile strength and 0.2% proof stress, cannot be secured by artificial aging. On the other hand, when the Si content exceeds 1.5 mass %, coarse single body Si particles are crystallized and precipitated in casting and in the middle of quenching after the solution heat treatment. Si which does not form a solid solution in the middle of quenching does not precipitate as $Mg_2Si$ (β' phase), do not contribute to enhancing the strength, and deteriorate corrosion resistance and toughness. The content of Si is to be 0.7-1.5 mass %, accordingly.

(Fe: 0.5 Mass % or Less)

Fe is included as an impurity element. Fe forms Al—Fe—Si—(Mn,Cr)-based crystallized and precipitated products such as $Al_7Cu_2Fe$, $Al_{12}(Fe,Mn)_3Cu_2$, $(Fe,Mn)Al_6$ and the like. These crystallized and precipitated products deteriorate the fracture toughness, fatigue properties and the like. Particularly, when the Fe content exceeds 0.5 mass %, these crystallized and precipitated products increase, and the aluminum alloy forged material having high enough strength such as elongation and high enough toughness required for structural materials of transportation vehicles and the like cannot be secured. Fracture toughness and elongation are related with each other. Fatigue strength and tensile strength are related with each other. Improving toughness and fatigue strength, therefore, leads to improvement of elongation and tensile strength. The content of Fe is regulated to 0.5 mass % or less, accordingly. The content of Fe is preferably 0.3 mass % or less.

(Cu: 0.1-0.6 Mass %)

Cu contributes to enhancement of tensile strength for the material by solid solution strengthening. Furthermore, Cu has an effect to significantly promote age hardening of the final product in the step of the artificial aging treatment. When the content of Cu is less than 0.1 mass %, these effects cannot be expected, and sufficient mechanical strength such as tensile strength and 0.2% proof stress, for example, cannot be obtained. In order to secure these effects, the content of Cu is preferably controlled to 0.3 mass % or more. On the other hand, when the content of Cu exceeds 0.6 mass %, it extremely increases the sensitivity of stress corrosion crack and intergranular corrosion of the structure of the aluminum alloy forged material, and deteriorates the corrosion resistance and durability of the aluminum alloy forged material. Further, the elongation is significantly deteriorated due to excessive mechanical strength. Therefore, the content of Cu is to be 0.1-0.6 mass %.

(Mg: 0.6-1.2 Mass %)

Mg is an essential element for precipitating as $Mg_2Si$ (β' phase) along with Si by artificial aging treatment, and imparting high strength (0.2% proof stress) when the aluminum alloy forged material which is the final product is used. When the Mg content is less than 0.6 mass %, the age hardening amount reduces and sufficiently high strength such as for example tensile strength, 0.2% proof stress, and elongation is not obtained. On the other hand, when the Mg content exceeds 1.2 mass %, the strength (0.2% proof stress) increases excessively and forgeability of the material is impeded. Also, a large amount of $Mg_2Si$ is liable to precipitate in the middle of quenching after the solution heat treatment, delay of quenching is likely to occur, and thus high tensile strength is hardly realized. Moreover, the elongation is liable to be deteriorated because coarse crystal precipitates are likely to be formed. The content of Mg is to be 0.6-1.2 mass %, accordingly.

(Ti: 0.01-0.1 Mass %)

Ti is added to the aluminum alloy to make crystal grains finer in the form of such as $Al_3Ti$ and $TiB_2$ to improve the strength of the material. If a content of Ti is less than 0.01 mass %, the crystal grains does not become sufficiently fine and the high enough strength such as tensile strength is not obtained. On the other hand, if the content of Ti is higher than 0.1 mass %, coarse precipitated crystalline particles such as $Al_3Ti$ are formed and high enough strength such as elongation is not obtained. The content of Ti is to be in a range of 0.01-0.1 mass %, accordingly.

(Mn: 0.25-1.0 Mass %)

Mn forms dispersed particles (dispersed phase) of $Al_6Mn$ during the homogenizing heat treatment step and the subsequent hot forging step. Because these dispersed particles have the effect of impeding grain boundary movement after recrystallization, fine crystal grains and sub grains which improves fracture toughness and fatigue properties of the alloy can be obtained. If the content of Mn is less than 0.25 mass %, such effect cannot be expected and the material is liable to recrystallize. Once the recrystallization proceeds, metal textures other than the <111> texture are liable to be formed. Therefore, it becomes difficult to maintain the area ratio of the <111> texture in a cross section parallel to the extrusion direction of 60% or more. As a result of the undesirable metal texture, sufficient mechanical strength such as for example tensile strength and 0.2% proof stress cannot be secured. The recrystallized structure can be revealed from macro-texture of the material which is made observable by chemical etching by using a cupric chloride aqueous solution. Detailed procedure to determine the area ratio of the <111> texture is described later. On the other hand, when the content of Mn exceeds 1.0 mass %, coarse crystallized and precipitated products such as $Al_6Mn$ are liable to be formed, deteriorating the strength such as elongation. The content of Mn is to be in a range of 0.25-1.0 mass %, accordingly.

(Zn: 0.05 Mass % or Less)

When $MgZn_2$ can be precipitated finely and with high density at the time of artificial aging treatment by presence of Zn, high tensile strength can be achieved. On the other hand, when the content of Zn exceeds 0.05 mass %, the amount of Mg decreases, leading to decrease of $Mg_2Si$ which contributes to enhancement of the tensile strength, and sufficiently high mechanical strength such as for example tensile strength and 0.2% proof stress, cannot be secured. Also, $MgZn_2$ becomes coarse under an artificial temper ageing treatment condition in which $Mg_2Si$ compound precipitates, which results in a sufficiently high tensile strength of the forged material being not obtained. The Zn content is to be restricted to 0.05 mass % or less, accordingly.

Zn is taken into molten metal relatively easily by the raw materials such as scraps. Therefore, it is effective to reduce the consumption of the scrap of the low quality in order to regulate the content of Zn to less than 0.05 mass %.

(At Least One of 0.1-0.4 Mass % of Cr and 0.01-0.2 Mass % of Zr)

Cr and Zr forms dispersed particles (dispersed phase) of Al—Cr compounds such as $Al_2Mg_2Cr$ and Al—Zr compounds or the like which precipitates during the homogenizing heat treatment step and subsequent the hot forging step. Since these dispersed particles have an effect of preventing grain boundaries from moving after recrystallization, fine crystal grains or fine sub grains are obtained. Therefore, movement of crystal grain boundaries and sub grain boundaries are suppressed. Significant effect of refining crystal grains and forming sub grains is obtained. In particular, Zn forms dispersed particles of Al—Zr compounds which are even minuter than dispersed particles of Al—Mn and Al—Cr compounds of several tens to several hundreds of angstrom in size. Accordingly, Zr has a more significant effect of preventing crystal grain boundaries and sub grain boundaries from moving, refining crystal grains and forming sub grains. As a result, the fracture toughness and fatigue characteristics of the alloy are improved. These effects may be secured by containing at least one of Cr and Zr within the range specified for each elements. If the content of both of these elements is less than needed, the above mentioned effect is not obtained. The recrystallization of the material is liable to proceed, which makes maintaining the area ratio of the <111> texture in a cross section parallel to the extrusion direction of 60% or more difficult. As a result of the undesirable metal texture, sufficient mechanical strength such as for example tensile strength and 0.2% proof stress cannot be secured. On the other hand, if the content of one of these elements is higher than its upper limit as explained, coarse crystals of a compound such as $Al_2Mg_2Cr$, other Al—Cr compounds and Al—Zr compounds are formed. Such coarse precipitated crystals tend to become an origin for fracture and a cause for lowering the toughness the aluminum alloy. Sufficient mechanical strength such as for example tensile strength and 0.2% proof stress cannot be secured. At least one of 0.1-0.4 mass % of Cr and 0.01-0.2 mass % of Zr is thus to be contained in the material.

(Hydrogen: 0.25 ml/100 g-Al or Less)

Hydrogen ($H_2$) is liable to cause forging defect such as blow holes and the like caused by hydrogen, becomes the start point of fracture, and therefore is liable to significantly deteriorate the toughness and fatigue properties of the final product as well as mechanical properties of the highly strengthened forged material. The content of hydrogen, therefore, is to be regulated to 0.25 ml or less in 100 gram of Al (described as 0.25 ml/100 g-Al or less) as measured by a Ransley-type gas analyzer.

Hydrogen is incorporated from the air into molten metal during casting and melting aluminum alloy. It is therefore possible to control the amount of hydrogen by, for example, a degassing treatment of flowing inert gas such as argon, nitrogen or the like in the melted aluminum alloy and let the hydrogen diffuse to the bubbles of the inert gas.

(Inevitably Contained Impurities)

Elements such as B, C, Na, Ni, Hf, V, Cd and Pb are inevitably contained in the aluminum alloy and as small an amount of these elements as not to affect the property of the aluminum alloy is permitted to be included in the aluminum alloy forged material of the present embodiment. To be specific, an amount of each of these elements has to be less than or equal to 0.05 mass % and a total amount of these elements has to be 0.15 mass %.

(Area Ratio of the <111> Texture of 60% or More in a Cross Section Parallel to the Extrusion Direction)

The area ratio of the <111> texture in a cross section parallel to the extrusion direction is determined by using a SEM-EBSP (Scanning Electron Microscope—Electron Backscatter Diffraction Pattern) apparatus. The texture represents dominant crystallographic planes or directions in an alloy. It is also one of factors governing the mechanical strength of the alloy. It has been elucidated by the present inventors that the <111> texture is one of integrated orientations mainly formed by an extrusion step, and that the alloy material becomes tougher if the <111> texture is dominant as compared to those with other integrated orientations which is more likely to be formed by the extrusion. As described below, higher mechanical strength can be secured by developing the <111> texture under a specific condition of the extrusion step.

After the forging, it is possible to control the area ratio of the <111> texture to 60% or more in a cross section parallel to the extrusion direction by conducting each of the steps so that the coarsening the crystal grains by recrystallization and the decrease of the <111> texture are suppressed. Detailed descriptions of the extrusion and forging steps and the steps after the forging step are explained later in the specification. If the area ratio of the <111> texture in a cross section parallel to the extrusion direction is less than 60%, the texture becomes inappropriate and it becomes difficult to realize the desirably high mechanical strength for the material. The area ratio of the <111> texture is preferable determined as described later in Example section.

(Tensile Strength of 400 MPa or More and Elongation of 10.0% or More)

By controlling the area ratio of the <111> texture to 60% or more in a cross section parallel to the extrusion direction, the mechanical strength is enhanced in the forged material A according to the present embodiment having a chemical composition which should inherently show lower strength. Such enhancement in the mechanical strength may be secured in the material by controlling the tensile strength to 400 MPa or more and the elongation to 10.0% or more. If the tensile strength is less than 400 MPa or the elongation is less than 10.0%, the mechanical strength might not be enhanced to high enough to satisfy the high level of standard which is required recently. The tensile strength is thus controlled to 400 MPa or more and the elongation is controlled to 10.0% or more.

It is noted here that in the mechanical properties, 0.2% proof stress is also included. The 0.2% proof stress of the forged material A is to be 380 MPa or more, and preferably 400 MPa or more. By controlling the 0.2% proof stress to the range, the enhancement of the forged material A can be more secured.

(Region where the Recrystallized Grains Exist is 5 mm or Less as Measured from the Surface of the Forged Material)

The region where the recrystallized grains exist is preferably 5 mm or less as measured from the surface of the forged material A according to the present embodiment. By controlling the region in this manner, it is possible to circumvent deterioration of strength of the product as well as propagation of cracks generated by stress corrosion and/or fatigue, and to improve the reliability of the product. If the region is more than 5 mm as measured from the surface of the forged material, not only deterioration of strength of the product but also propagation of cracks generated by stress corrosion and/or fatigue are likely to occur, and the reliability of the product might be significantly degraded. The depth of recrystallization is preferably determined as explained in Example section below.

According to the forged material A of the above-described present embodiment with appropriate alloying composition and metal structure, 0.2% proof stress may be enhanced to 380 MPa or more, or even to 400 MPa or more depending on a process condition. Further, the tensile strength and elongation can be enhanced to 400 MPa or more and 10.0% or more, respectively.

(Method for Manufacturing the Aluminum Alloy Forged Material for an Automobile)

Next, the method for manufacturing the aluminum alloy forged material for an automobile (simply referred as manufacturing method hereinafter) in relation with an embodiment of the present invention is explained by referring to FIG. 3.

Figure 3:
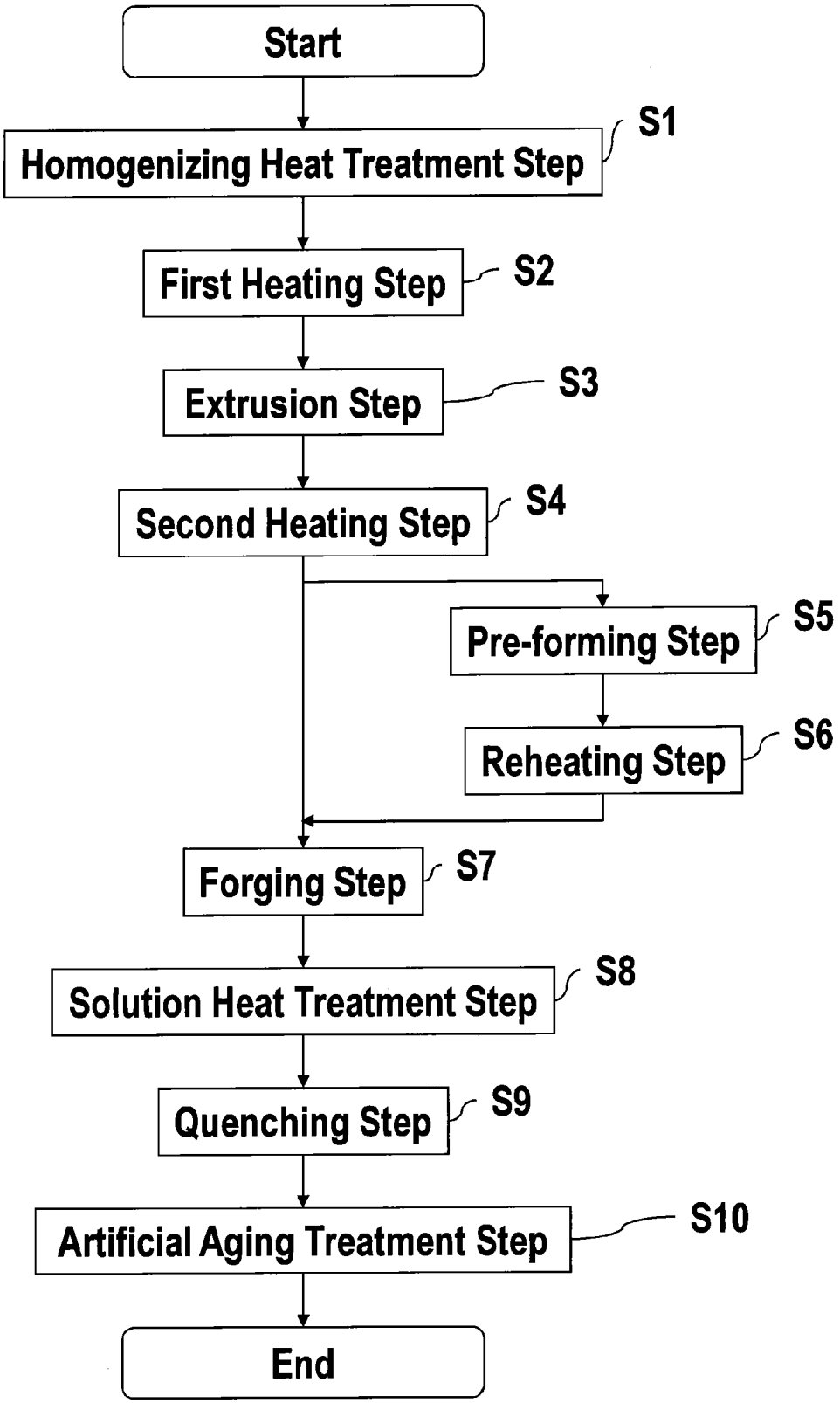
FIG. 3 is a flow chart indicating processes for a production method for the aluminum alloy forged material for an automobile in relation with an embodiment according to the present invention.

As illustrated in FIG. 3, the manufacturing method in relation with the embodiment includes, in the following order, a homogenizing heat treatment step S1, a first heating step S2, an extrusion step S3, a second heating step S4, a forging step S7, a solution heat treatment step S8, a quenching step S9, and an artificial aging treatment step S10. Each of these steps is explained in detail hereinafter.

For various equipment and facilities such as heating furnaces used in each step, general equipment which is used to produce forging materials may be used.

In addition, the ingot subjected to the homogenizing heat treatment in the step S1 may be casted in general conditions. It may be casted in a casting step (not shown as a figure) of the following condition for example.

(Casting Step)

In the casting step, the ingot can be casted, for example, by dissolving an aluminum alloy having the above-described composition at a casting temperature of 700-780° C.

When the heating temperature is below 700° C., the temperature is liable to become lower than the solidifying temperature, the molten metal becomes liable to be solidified inside a mold, and making the casting difficult. When the heating temperature exceeds 780° C., the molten metal becomes hard to be solidified. It is noted, however, that the casting temperature is not limited to the above mentioned temperature range. The casting temperature may be below 700° C. or may exceed 780° C. as long as the casting can be conducted.

(Homogenizing Heat Treatment Step: S1)

The homogenizing heat treatment step S1 is a step of subjecting the ingot to homogenizing heat treatment at 450-560° C. for 3-12 hours, and to cooling at the rate of 0.5° C. or more to 300° C. or below. When the homogenizing heat treatment temperature is less than 450° C., the homogenizing heat treatment does not sufficiently proceed, Si, Mg, or the like does not sufficiently dissolve in the alloy and the refinement of the size of crystallized and precipitated products is liable to be inadequate, resulting in undesirable mechanical strength such as for example tensile strength and elongation. When the homogenizing heat treatment temperature exceeds 560° C., the dispersed particles become coarse and the density decreases, and the recrystallization is liable to occur, which makes maintaining the area ratio of the <111> texture in a cross section parallel to the extrusion direction of 60% or more difficult. As a result of the undesirable metal texture, sufficient mechanical strength such as for example tensile strength and 0.2% proof stress cannot be secured.

When the homogenizing heat treatment time is less than 3 hours, Si, Mg, or the like does not sufficiently dissolve in the alloy and the refinement of the size of crystallized and precipitated products is liable to be inadequate. It becomes difficult to secure the sufficient mechanical strength such as for example tensile strength and elongation. On the other hand, conducting the homogenizing heat treatment for more than 12 hours is not desirable since the treatment effect saturates and manufacturing cost increases. Further, if the cooling rate from the homogenizing heat treatment temperature down to 300° C. is less than 0.5° C., coarsening of the dispersed particles proceeds and the recrystallization is liable to occur, which also makes maintaining the area ratio of the <111> texture in a cross section parallel to the extrusion direction of 60% or more difficult as described above. As a result of the undesirable metal texture, sufficient mechanical strength such as for example tensile strength and 0.2% proof stress cannot be secured.

(First Heating Step: S2)

The first heating step S2 is a step of subjecting the homogenizing heat treated ingot to heating at temperatures of 450-540° C. The heating step is conducted for a purpose of improving the workability and suppressing the recrystallization of the material. If the temperature of heating is less than 450° C., the recrystallization is liable to occur, which makes maintaining the area ratio of the <111> texture in a cross section parallel to the extrusion direction of 60% or more difficult as described above. As a result of the undesirable metal texture, sufficient mechanical strength such as for example tensile strength and 0.2% proof stress cannot be secured. If the temperature of heating is more than 540° C., on the other hand, sufficiently high mechanical strength such as for example tensile strength and 0.2% proof stress may not be obtained because porosities are likely to be formed by burning.

(Extrusion Step: S3)

The extrusion step S3 is a step of subjecting the heated ingot to extrusion at temperatures of 450-540° C. with extrusion ratio of 6-25 at extrusion rate of 1-15 m/minute. By carrying out the extrusion step S3 under a condition within the specified range, the <111> texture develops in the forged material resulting in a desirably high mechanical strength. The extrusion step is therefore the most important process in the manufacturing method according to the present embodiment. The extrusion ratio indicates a change ratio between a cross section area of a material before extruded and a cross section area of an extruded material. Accordingly the extrusion ratio is obtained by measuring an area of a cross section of the material that is vertical to an extruding direction before and after the extruding process and dividing the area of the cross section before the extruding process by the area of the cross section after the extruding process. In the present embodiment, it is essential to conduct the subsequent steps, working ratio after forging in particular, under relatively mild conditions in order to avoid degrading the <111> texture developed in the extrusion step.

If the extrusion temperature is less than 450° C., the recrystallization is liable to occur. It becomes difficult to develop the <111> texture and the recrystallization is liable to occur, which makes maintaining the area ratio of the <111> texture in a cross section parallel to the extrusion direction of 60% or more difficult as described above. As a result of the undesirable metal texture, sufficient mechanical strength such as for example tensile strength and 0.2% proof stress cannot be secured. If the extrusion temperature exceeds 540° C., on the other hand, friction on the surface of the work becomes so large that shear deformation is liable to occur. Large cracks are thus generated in the middle of the extrusion.

Also, if the extrusion ratio is less than 6, there exists a part of the work which does not have the texture. It becomes difficult to develop the <111> texture, which makes maintaining the area ratio of the <111> texture in a cross section parallel to the extrusion direction of 60% or more difficult. As a result of the undesirable metal texture, sufficient mechanical strength such as for example tensile strength and 0.2% proof stress cannot be secured. On the other hand, if the extrusion ratio is more than 25, excessive working ratio induces recrystallization of the material. Not only the development of the <111> texture becomes impossible, but also the recrystallization becomes liable to be induced, which makes maintaining the area ratio of the <111> texture in a cross section parallel to the extrusion direction of 60% or more difficult as described above. As a result of the undesirable metal texture, sufficient mechanical strength such as for example tensile strength and 0.2% proof stress cannot be secured.

If the ingot is extruded at the extrusion rate less than 1 m/minute, the temperature of the ingot to be extruded lowers before the extrusion. It becomes difficult to develop the <111> texture, which makes maintaining the area ratio of the <111> texture in a cross section parallel to the extrusion direction of 60% or more difficult. As a result of the undesirable metal texture, sufficient mechanical strength such as for example tensile strength and 0.2% proof stress cannot be secured. On the other hand, if the ingot is extruded at the extrusion rate more than 15 m/minute, the ingot being extruded is liable to be heated and melted. Even if it does not reach the melting condition, the heat generated by the working makes development of the <111> texture difficult, which makes maintaining the area ratio of the <111> texture in a cross section parallel to the extrusion direction of 60% or more difficult. As a result of the undesirable metal texture, sufficient mechanical strength such as for example tensile strength and 0.2% proof stress cannot be secured.

Figure 4:
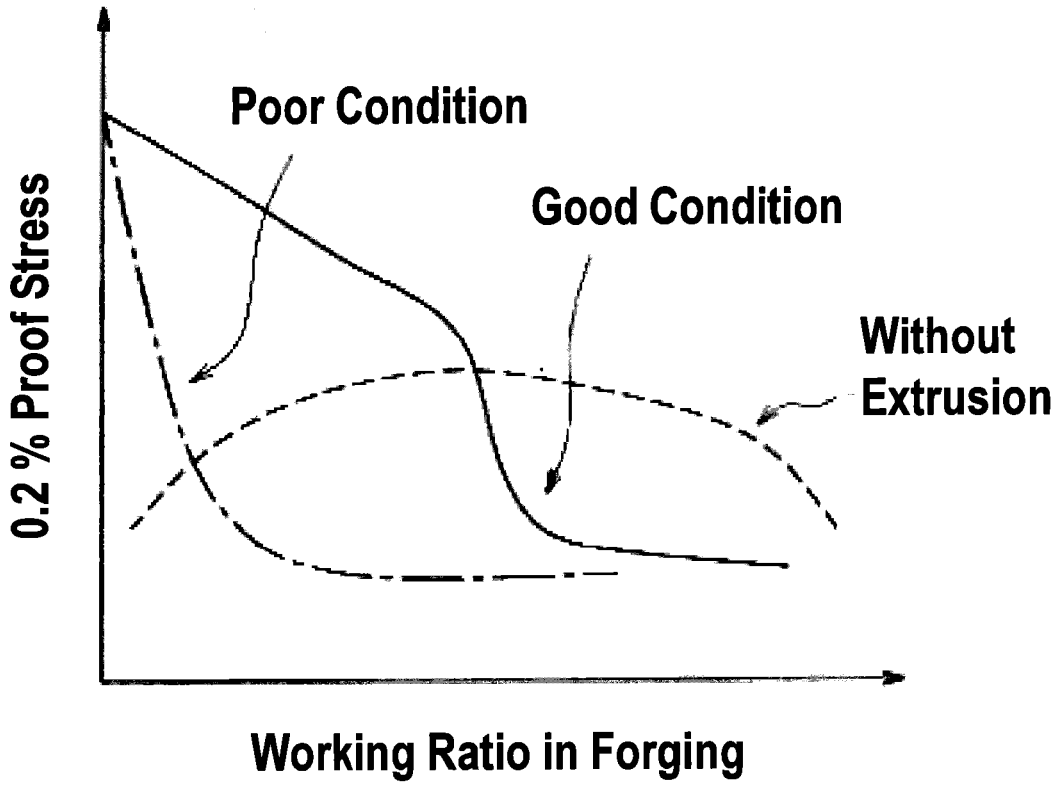
FIG. 4 is a graph in which the 0.2% proof stress is plotted with respect to the extrusion ratio. A curve line for a product in a predetermined shape extruded under a condition described in embodiments according to the present invention is drawn with a solid line and tagged "good condition". A curve for that extruded under a condition not in accord with the present embodiments is plotted with an alternate long and short dash line and tagged "poor condition". A curve for that prepared without an extrusion step is plotted with a broken line and tagged "without extrusion".

As illustrated in FIG. 4, a shaped product for which the extrusion is conducted under a condition not in accord with the present embodiment (plotted with an alternate long and short dash line and tagged "poor condition") shows a sharp decline in terms of the 0.2% proof stress as soon as it is subjected to forging or other processing in the subsequent step. Also, a shaped product for which the extrusion is skipped (plotted with a broken line and tagged "without extrusion") shows a gradual increase in terms of the 0.2% proof stress as the working ratio increases in the forging step. However, its 0.2% proof stress turns to gradual decrease before it reaches to the specified range of the 0.2% proof stress. It is noted here that included in the working ratio are maximum equivalent plastic strain in the forging step as well as temperature and duration in the steps of forging, solution heat treatment, quenching, and artificial aging treatment.

On the other hand, a shaped product for which the extrusion is conducted under a condition in accord with the present embodiment (plotted with a solid line and tagged "good condition") maintains the 0.2% proof stress of specified range, 380 MPa for example, or more to relatively high working ratio when it is subjected to the forging or other processing in the subsequent step. In other words, this means that a shaped product extruded under a condition in accord with the present embodiment can provide a highly strengthened forged material A if it is subjected to post-forging working in a relatively mild condition (low working ratio) so that it maintains the specified value of 0.2% proof stress or more.

(Second Heating Step: S4)

The second heating step S4 is a step of subjecting the forged product in predetermined shape to heating at temperatures of 500-560° C. for 0.75 hours or more. The heating treatment is carried out for the purpose of decreasing deformation resistance in the forging step and suppressing recrystallization of the material. If the heating temperature is less than 500° C., the recrystallization is liable to occur, which makes maintaining the area ratio of the <111> texture in a cross section parallel to the extrusion direction of 60% or more difficult. As a result of the undesirable metal texture, sufficient mechanical strength such as for example tensile strength and 0.2% proof stress cannot be secured. On the other hand, if the heating temperature exceeds 560° C., burning, a phenomenon in which intermetallic compounds of low melting point melt, is liable to occur. The portion where the burning occurred turns to porosities which deteriorate the mechanical strength of the material. If the heating temperature exceeds 560° C., dispersed particles formed during the homogenizing heat treatment become coarse, the density of the particle decreases, and the recrystallization is liable to occur, which makes maintaining the area ratio of the <111> texture in a cross section parallel to the extrusion direction of 60% or more difficult as described above. As a result of the undesirable metal texture, sufficient mechanical strength such as for example tensile strength and 0.2% proof stress cannot be secured. Further, if the heating time exceeds 0.75 hour, inner portion of the material is insufficiently heated as compared to outer portion where the recrystallization is again liable to occur, which makes maintaining the area ratio of the <111> texture in a cross section parallel to the extrusion direction of 60% or more difficult as described above. As a result of the undesirable metal texture, sufficient mechanical strength such as for example tensile strength and 0.2% proof stress cannot be secured.

(Forging Step: S7)

The forging step S7 is a step of subjecting the heated product of in predetermined shape to forging at forging start temperature of 450-560° C., forging finish temperature of 420° C. or more, and a maximum equivalent plastic strain of 3 or less to obtain a forged material of a predetermined shape. If the forging start temperature is less than 450° C., the forging finish temperature is also lowered to less than 420° C. If the forging start temperature and the forging finish temperature are below the lower limit temperature, the recrystallization is liable to occur, which makes maintaining the area ratio of the <111> texture in a cross section parallel to the extrusion direction of 60% or more difficult. As a result of the undesirable metal texture, sufficient mechanical strength such as for example tensile strength and 0.2% proof stress cannot be secured. If the forging start temperature is more than 560° C., burning, a phenomenon in which intermetallic compounds of low melting point melt, is liable to occur. Moreover, due to embrittlement of grain boundaries, a large crack is liable to be induced in the course of the forging step. The recrystallization is also liable to be induced if the maximum equivalent plastic strain exceeds 3. Once the recrystallization proceeds, maintaining the area ratio of the <111> texture in a cross section parallel to the extrusion direction of 60% or more becomes difficult. As a result of the undesirable metal texture, sufficient mechanical strength such as for example tensile strength and 0.2% proof stress cannot be secured. The equivalent plastic strain varies depending on the portion of the forged material. In the present invention, the maximum equivalent plastic strain is defined as the maximum value among the various values of the equivalent plastic strain. The maximum equivalent plastic strain e can be calculated by $\epsilon=|\ln(L/L0)|$ where In means natural logarithm, L and L0 are dimensions of a test material before and after the uniaxial compressive stress is applied, respectively. If the maximum equivalent plastic strain is set to 3 or less, 0.2% proof stress, for example, can be controlled to 380 MPa or more. Further, if the maximum equivalent plastic strain is controlled to 1.5 or less, even higher mechanical strength can be obtained. The 0.2% proof stress, for example, reaches 400 MPa or more.

(Solution Heat Treatment Step: S8)

The solution heat treatment step S8 is a step in which the forged material is subjected to solution heat treatment at 480-560° C. for 2-8 hours. When the solution heat treatment is conducted at a temperature of less than 480° C. or for less than 2 hours, the solution heat treatment does not sufficiently proceed, sufficient mechanical strength (for example, tensile strength and elongation) may not be obtained. When the solution heat treatment is conducted at a temperature exceeding 560° C., the recrystallization tends to occur, which makes maintaining the area ratio of the <111> texture in a cross section parallel to the extrusion direction of 60% or more difficult. As a result of the undesirable metal texture, sufficient mechanical strength such as for example tensile strength and 0.2% proof stress cannot be secured. Furthermore, also when the solution heat treatment is conducted for longer than 8 hours, the recrystallization tends to occur, which makes maintaining the area ratio of the <111> texture in a cross section parallel to the extrusion direction of 60% or more difficult. As a result of the undesirable metal texture, sufficient mechanical strength such as for example tensile strength cannot be secured.

(Quenching Step: S9)

The quenching step S9 is a step of subjecting the forged material having been subjected to the solution heat treatment to quenching treatment at 70° C. or below. When the treatment temperature exceeds 70° C., quench hardening at a sufficient cooling rate is impossible, and therefore sufficient strength such as for example tensile strength and 0.2% proof stress cannot be secured.

(Artificial Aging Treatment Step: S10)

The artificial aging treatment step S10 is a step of subjecting the forged material having been subjected to the quenching to artificial aging treatment at 140-200° C. for 3-12 hours. When the treatment temperature is below 140° C. or the treatment time is less than 3 hour, the artificial aging treatment does not proceed sufficiently and the inadequate temper aging causes sufficient mechanical strength such as tensile strength and 0.2% proof stress for example cannot be obtained. Also, when the treatment temperature is higher than 200° C. or the treatment time is longer than 12 hours, the excessive temper aging causes softening the forged material and insufficient mechanical strength such as tensile strength and 0.2% proof stress, for example.

The manufacturing method according to the present embodiment includes each of the above-described processing steps. By processing the steps in this order, highly strengthened forged material A can be obtained. As long as the effects desired for the present invention are developed, a step other than the aforementioned steps may be added. Examples of such an additional step are a pre-forming step S5 and a reheating step S6 illustrated in FIG. 3. The pre-forming step S5 and reheating step S6 are preferably added between the second heating step S4 and the forging step S7. Further, it is also possible to reduce the area size of cross section of the portion of an extrusion rod in advance by peeling or cutting or the like in such a case local working ratio gets excessively large in the forging step.

(Pre-Form Step: S5)

The pre-form step S5 is a step for pre-form shaping of the ingot and can be executed prior to the forging step S7. The temperature of the pre-forming is to be 450-560° C. which is the start temperature of forging the extrudate in the forging step S7.

(Reheating Step: S6)

The reheating step S6 is a step to reheat the shaped product which has been cooled by being subjected to the pre-forming step to a range of temperature suited to conduct the finishing forging by subjecting the product to the forging step S7. The reheating temperature is therefore preferably controlled to 450-560° C. as for the start temperature of forging the extrudate in the forging step S7. It is noted here that the reheating step S6 need not to be conducted if the temperature decrease is small in the shaped product subjected to the preform step S5, more specifically if the temperature of the shaped product subjected to the pre-form step S5 is 450° C. or higher.

Examples

Next, the present invention is specifically described based on examples. The properties evaluated in the invention examples and comparative examples are as described below.

[1] Study of the Alloy Composition

Firstly, an ingot was casted at 700° C. by melting aluminum alloys of compositions shown in Nos. 1-32 in Table 1. It is noted here that underlined values in Table 1 indicate that they are out of the range required for the present invention. $H_2$ in Table 1 shows the amount of hydrogen in each of the aluminum alloys of 100 gram in mass (in ml/100 g-Al or less) as measured by a Ransley-type gas analyzer. The amount of each of the inevitable impurities was 0.05 mass % or less, and the total amount of inevitable impurities was 0.15 mass % or less.

Next, the homogenizing heat treatment was conducted by subjecting the ingot to homogenizing heat treatment at 480° C. for 5 hours and subsequently cooled at a rate of 1° C./minute down to 300° C. or lower.

Then, the ingot was heated to 500° C., and further subjected to an extrusion at an extrusion rate of 4 m/minute and a temperature of 490° C. with an extrusion ratio of 12. The extruded product in a predetermined shape was subsequently reheated at 520° C. for 1.5 hours. The reheated product was then processed under a condition of forging start temperature of 510° C., forging finish temperature of 520° C., and a maximum equivalent plastic strain of 1.5 to obtain a forged material of I shape.

Then, the forged material was subjected to a solution heat treatment at 540° C. for 4 hours, followed by quenching at 50° C. The quenched material was finally subjected to an artificial aging treatment at 175° C. for 8 hours to obtain each of the forged material according to the finishing products Nos. 1-32. Hereinbelow, forged materials manufactured in the aforementioned manner are simply referred as "forged material No. 1" or the like for the purpose of illustration.

Mechanical strength including tensile strength (in MPa), 0.2% proof stress (in MPa), and elongation (in %) was evaluated as mechanical properties for the forged materials Nos. 1-32. Here, EBSP The results are shown in Table 2. Area ratio (in %) of the <111> texture in a cross section parallel to the extrusion direction was also acquired by using a SEM-EBSP apparatus (JSM-7000 field-emission type SEM manufactured by JEOL, Ltd., equipped with an EBSP detector manufactured by TexSEM Laboratories, Inc.). Further, region where the recrystallized grains exist (depth of recrystallization T) was measured as described below. These results are shown in Table 2.

Here, EBSP (Electron backscatter diffraction patterns) consist of symmetrically arranged Kikuchi patterns (Kikuchi lines) due to the diffraction of the backscattered electrons from the surface of crystal specimen. By analyses of the patterns, crystallographic directions of individual crystal grains at the incident electron beam spot may be determined. Here, Kikuchi patterns mean pairs of parallel lines or bands or arrays of spots in the diffraction pattern formed by electrons which are inelastically scattered by atomic planes of a crystal.

(Mechanical Properties)

Figure 5A:
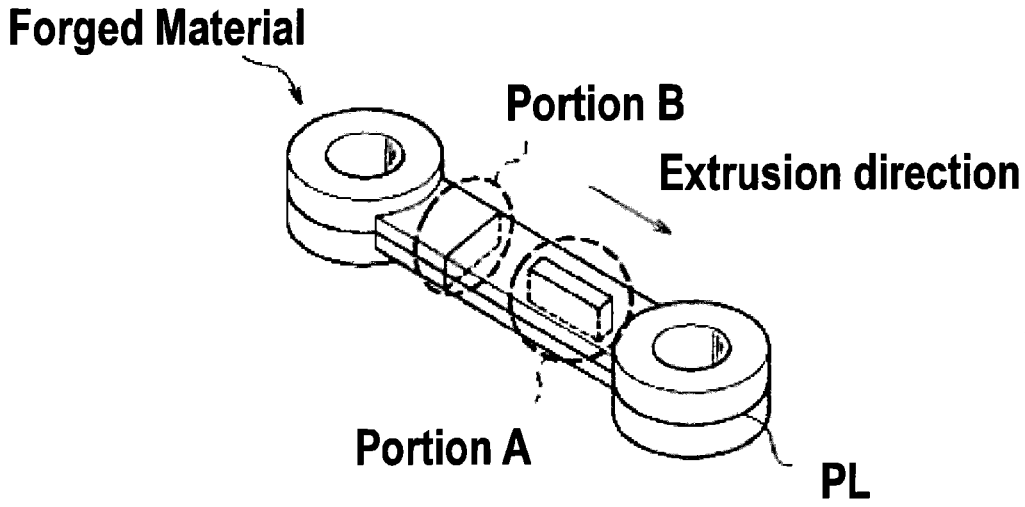
FIGS. 5A-5C are illustrations about observation of texture and measurement of region where the recrystallized grains exist (depth of recrystallization) in the I-shaped forged material.

Test peaces under JIS Z 2201 No. 4 were cut out from the forged materials of I-shape in longer direction (the extrusion direction in FIG. 5) and tensile tests are carried out according to JIS Z 2241 to evaluate their mechanical properties. Average value was calculated from measured values for 5 test pieces.

In the present invention, materials having tensile strength of 400 MPa or more are evaluated as acceptable while those having tensile strength of less than 400 MPa are categorized as unacceptable. Regarding 0.2% proof stress, materials having 0.2% proof stress of 380 MPa or more are evaluated as acceptable while those having 0.2% proof stress of less than 380 MPa are categorized as unacceptable. Regarding elongation, materials having elongation of 10.0% or more are evaluated as good while those having elongation of less than 10.0% are categorized as no good.

(Observation of Metal Texture)

Figure 5B:
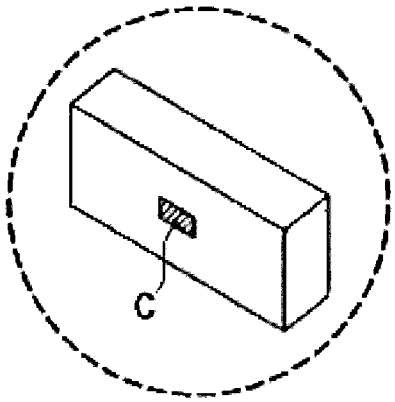
Figure 6:
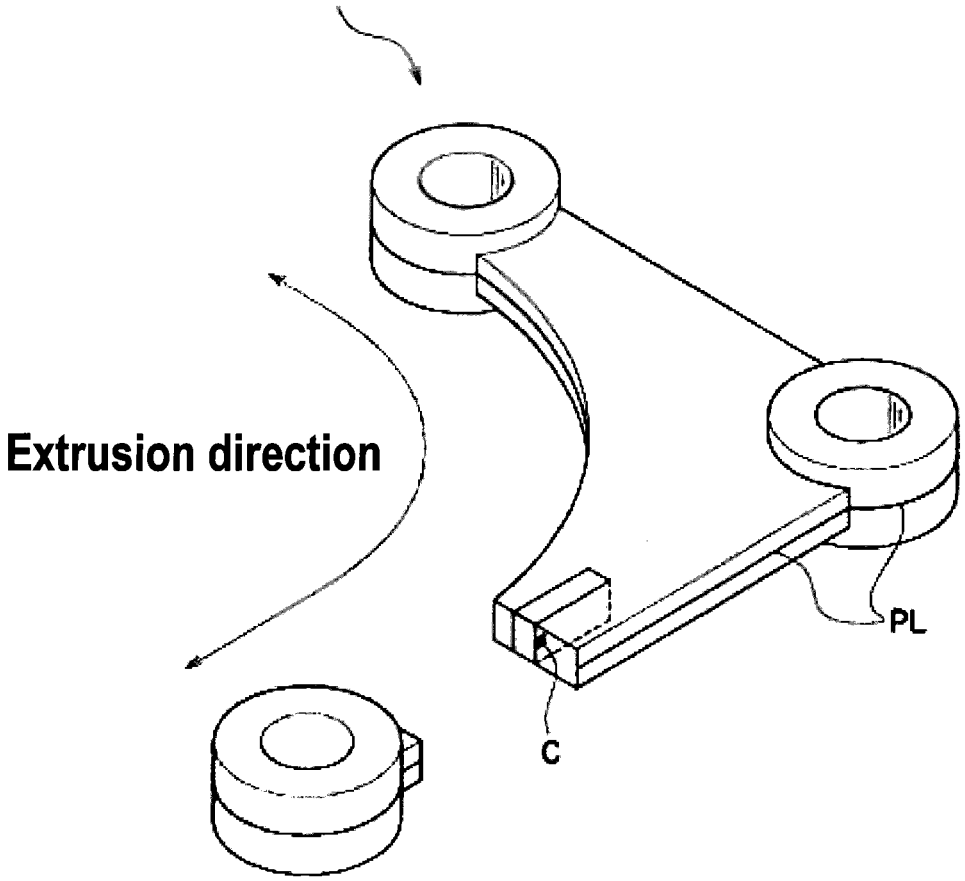
FIG. 6 is an illustration about the measurement of region where the recrystallized grains exist (depth of recrystallization) in the L-shaped forged material.

The metal texture of the material was observed as described below. A sample for observation was cut out of the I-shaped forged material shown in FIG. 5A by a cross section which is parallel to the extrusion direction and is perpendicularly striding the parting line (PL) as well at a position where the cross-sectional area became the minimum. See FIGS. 5A and 5B. FIG. 5B is a magnified view of part A in FIG. 5A. The texture of the sample was observed on the surface C which is the central portion of the cross section cut out of the sample. As for the L-shaped forged material, a sample for observation was cut out in the similar manner as illustrated in FIG. 6.

The cut surface was polished with water-proof paper of #600 to #1,000, followed by electrochemical polishing to obtain a mirror-finished surface for observation. The texture of the sample was observed by using the SEM-EBSP at a magnification of ×400. By analyzing the SEM-EBSP image, the area ratio of the <111> texture in a cross section parallel to the extrusion direction was determined. In the present invention, materials having the area ratio of the <111> texture in a cross section parallel to the extrusion direction of 60% or more are evaluated as good while those having the area ratio of less than 60% are categorized as no good. It is noted that the area ratio of the <111> texture in a cross section parallel to the extrusion direction is described simply as <111> texture in Tables 2 and 5.

(Depth of Recrystallization)

Figure 5C:
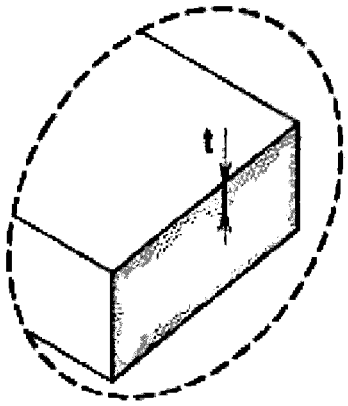

The depth of recrystallization was measured by the condition described below. The sample for measurement was cut out of the I-shaped forged material by a cross section perpendicularly striding the parting line (PL) at a position where the cross-sectional area became the minimum. See FIGS. 5A and 5C. FIG. 5C is a magnified view of part A in FIG. 5B. As shown in FIG. 6, the sample for measurement was cut out of the L-shaped forged material at the vicinity of joint of columnar shape where the aforementioned condition is satisfied.

After the cut surface was polished with water-proof paper of #600 to #1,000, the sample was etched by a cupric chloride aqueous solution. After being immersed in nitric acid, water cleaning and drying by air blow, macroscopic structure observation of the cross section of the cut part was executed. The distance of the recrystallized portion which corresponds to brightly-contrasted part of the surface layer (see FIG. 5C and hatched portion in FIG. 6) from the surface was measured in the cross section of the cut part, and the distance at a position where the distance became the maximum was made the depth of recrystallization T (in mm).

TABLE 1

| Forged Material No. | Alloy composition (mass %); the remainder being Al and inevitable impurities | | | | | | | | | |
|---|---|---|---|---|---|---|---|---|---|---|
| | Si | Fe | Cu | Mg | Ti | Zn | Mn | Cr (optional) | Zr (optional) | $H_2$ |
| 1 | 0.70 | 0.22 | 0.40 | 0.90 | 0.02 | less than 0.02 | 0.70 | 0.20 | less than 0.01 | 0.15 |
| 2 | 1.20 | 0.05 | 0.40 | 0.90 | 0.02 | less than 0.02 | 0.70 | 0.20 | less than 0.01 | 0.15 |
| 3 | 1.20 | 0.22 | 0.60 | 0.90 | 0.02 | less than 0.02 | 0.70 | 0.20 | less than 0.01 | 0.15 |
| 4 | 1.20 | 0.22 | 0.40 | 0.90 | 0.02 | less than 0.02 | 1.00 | 0.20 | less than 0.01 | 0.15 |
| 5 | 1.20 | 0.22 | 0.40 | 0.90 | 0.02 | less than 0.02 | 0.25 | 0.20 | less than 0.01 | 0.15 |
| 6 | 1.20 | 0.22 | 0.40 | 0.60 | 0.02 | less than 0.02 | 0.70 | 0.20 | less than 0.01 | 0.15 |
| 7 | 1.20 | 0.22 | 0.40 | 0.90 | 0.10 | less than 0.02 | 0.70 | 0.20 | less than 0.01 | 0.15 |
| 8 | 1.20 | 0.22 | 0.40 | 0.90 | 0.10 | less than 0.02 | 0.70 | less than 0.01 | 0.10 | 0.15 |
| 9 | 1.20 | 0.22 | 0.40 | 0.90 | 0.02 | less than 0.02 | 0.70 | 0.20 | 0.15 | 0.15 |
| 10 | 1.20 | 0.22 | 0.10 | 0.90 | 0.02 | less than 0.02 | 0.70 | 0.20 | less than 0.01 | 0.15 |
| 11 | 1.50 | 0.22 | 0.40 | 0.90 | 0.02 | less than 0.02 | 0.70 | 0.20 | less than 0.01 | 0.15 |
| 12 | 0.60 | 0.22 | 0.40 | 0.90 | 0.02 | less than 0.02 | 0.70 | 0.20 | less than 0.01 | 0.15 |
| 13 | 1.60 | 0.22 | 0.40 | 0.90 | 0.02 | less than 0.02 | 0.70 | 0.20 | less than 0.01 | 0.15 |
| 14 | 1.20 | 0.60 | 0.40 | 0.90 | 0.02 | less than 0.02 | 0.70 | 0.20 | less than 0.01 | 0.15 |
| 15 | 1.20 | 0.22 | 0.01 | 0.90 | 0.02 | less than 0.01 | 0.70 | 0.20 | less than 0.01 | 0.15 |
| 16 | 1.20 | 0.22 | 0.70 | 0.90 | 0.02 | less than 0.02 | 0.70 | 0.20 | less than 0.01 | 0.15 |
| 17 | 1.20 | 0.22 | 0.40 | 0.50 | 0.02 | less than 0.02 | 0.70 | 0.20 | less than 0.01 | 0.15 |
| 18 | 1.20 | 0.22 | 0.40 | 1.30 | 0.02 | less than 0.02 | 0.70 | 0.20 | less than 0.01 | 0.15 |
| 19 | 1.20 | 0.22 | 0.40 | 1.00 | less than 0.004 | less than 0.02 | 0.70 | 0.20 | less than 0.01 | 0.15 |
| 20 | 1.20 | 0.22 | 0.40 | 1.00 | 0.15 | less than 0.02 | 0.70 | 0.20 | less than 0.01 | 0.15 |
| 21 | 1.20 | 0.22 | 0.40 | 1.00 | 0.02 | 0.10 | 0.70 | 0.20 | less than 0.01 | 0.15 |
| 22 | 1.20 | 0.22 | 0.40 | 0.90 | 0.02 | less than 0.02 | 0.20 | 0.20 | less than 0.01 | 0.15 |
| 23 | 1.20 | 0.22 | 0.40 | 0.90 | 0.02 | less than 0.02 | 1.40 | 0.20 | less than 0.01 | 0.15 |
| 24 | 1.20 | 0.22 | 0.40 | 0.90 | 0.02 | less than 0.02 | 0.70 | less than 0.01 | less than 0.01 | 0.15 |
| 25 | 1.20 | 0.22 | 0.40 | 1.00 | 0.02 | less than 0.02 | 0.70 | less than 0.01 | 0.50 | 0.15 |
| 26 | 1.20 | 0.22 | 0.40 | 1.00 | 0.02 | less than 0.02 | 0.70 | 0.05 | less than 0.01 | 0.15 |
| 27 | 1.20 | 0.22 | 0.40 | 1.00 | 0.02 | less than 0.02 | 0.70 | 0.50 | less than 0.01 | 0.15 |
| 28 | 1.20 | 0.22 | 0.40 | 1.00 | 0.02 | less than 0.02 | 0.70 | 0.20 | 0.30 | 0.15 |
| 29 | 1.20 | 0.22 | 0.40 | 1.00 | 0.02 | less than 0.02 | 0.70 | 0.20 | less than 0.01 | 0.30 |
| 30 | 0.60 | 0.22 | 0.40 | 0.90 | 0.02 | less than 0.02 | 0.30 | 0.20 | less than 0.01 | 0.30 |
| 31 | 1.55 | 0.22 | 0.40 | 1.10 | 0.02 | less than 0.02 | 1.00 | 0.20 | less than 0.01 | 0.30 |
| 32 | 1.60 | 0.22 | 0.40 | 0.50 | 0.02 | less than 0.02 | 0.70 | 0.20 | less than 0.01 | 0.30 |

TABLE 2

| Forged Material No. | Mechanical properties | | | Texture | |
|---|---|---|---|---|---|
| | Tensile strength (MPa) | 0.2% proof stress (MPa) | Elongation (%) | <111> texture (%) | Depth of recrystallization T (mm) |
| 1 | 403 | 385 | 12.6 | 80 | 1 |
| 2 | 417 | 393 | 15.7 | 75 | 2 |
| 3 | 438 | 416 | 10.9 | 85 | 1 |
| 4 | 431 | 407 | 13.7 | 85 | 1 or less |
| 5 | 438 | 413 | 14.4 | 65 | 5 |
| 6 | 417 | 394 | 13.2 | 85 | 1 or less |
| 7 | 425 | 406 | 14.2 | 80 | 1 or less |
| 8 | 426 | 408 | 13.9 | 80 | 1 or less |
| 9 | 429 | 405 | 19.9 | 85 | 1 or less |
| 10 | 404 | 383 | 16.7 | 80 | 1 |
| 11 | 453 | 427 | 10.8 | 75 | 1 or less |
| 12 | 366 | 343 | 14.6 | 75 | 2 |
| 13 | 374 | 352 | 14.7 | 80 | 1 or less |

TABLE 2-continued

| Forged Material No. | Mechanical properties | | | Texture | |
|---|---|---|---|---|---|
| | Tensile strength (MPa) | 0.2% proof stress (MPa) | Elongation (%) | <111> texture (%) | Depth of recrystallization T (mm) |
| 14 | 434 | 412 | 8.3 | 85 | 1 |
| 15 | 381 | 361 | 15.1 | 80 | 1 |
| 16 | 467 | 439 | 9.2 | 75 | 1 |
| 17 | 381 | 358 | 21.6 | 80 | 1 or less |
| 18 | 408 | 382 | 6.0 | 80 | 1 or less |
| 19 | 379 | 367 | 14.8 | 70 | 2 |
| 20 | 423 | 404 | 7.9 | 80 | 1 or less |
| 21 | 380 | 361 | 24.2 | 80 | 1 or less |
| 22 | 378 | 357 | 12.0 | 55 | 7 |
| 23 | 417 | 396 | 6.1 | 85 | 1 or less |
| 24 | 375 | 352 | 23.0 | 35 | 8 |
| 25 | 372 | 370 | 4.5 | 85 | 1 or less |
| 26 | 380 | 358 | 17.7 | 40 | More than 10 |
| 27 | 376 | 352 | 21.3 | 45 | More than 10 |
| 28 | 387 | 363 | 9.4 | 60 | More than 10 |
| 29 | 419 | 397 | 7.2 | 80 | 1 or less |
| 30 | 353 | 329 | 21.4 | 70 | 8 |
| 31 | 438 | 416 | 7.4 | 80 | 1 or less |
| 32 | 444 | 440 | 4.5 | 80 | 1 |

As shown in Tables 1 and 2, forged materials Nos. 1-11 are excellent in terms of mechanical strength (mechanical properties) such as tensile strength, 0.2% proof stress, and elongation, satisfying the requirements of the present invention. Namely, the enhancement of mechanical strength of forged material has been achieved. Each of the forged materials is also excellent in terms of area ratio of the <111> texture in a cross section parallel to the extrusion direction. In particular, the test materials which satisfy the requirements in terms of the alloy composition for the present invention as well as have the area ratio of the <111> texture in a cross section parallel to the extrusion direction of 60% or more, showed enhanced mechanical strength of 0.2% proof stress of 380 MPa or more, preferably 390 MPa or more, and more preferably 400 MPa or more. Each of such materials possessed tensile strength of 400 MPa or more, and elongation of 10.0% or more as well.

Forged materials Nos. 12-32, on the other hand, did not satisfy at least one of the requirements according to the present invention. Therefore, they are inferior in terms of mechanical strength such as tensile strength, 0.2% proof stress, and elongation as shown in Table 2. Further, some of them did not reach the standard of area ratio of the <111> texture in a cross section parallel to the extrusion direction.

[2] Study of the Manufacturing Condition

Manufactured next under each of the conditions Nos. 33-67 shown in Tables 3 and 4 were forged materials having the alloy composition of forged material No. 3 which showed good result. Hereinbelow, forged materials manufactured in the aforementioned manner is simply referred as "forged material No. 33" or the like for the purpose of illustration. In Tables 3 and 4, underlined data values indicate that they do not satisfy the requirement for the present invention. Also, diagonally lined sections in Tables 3 and 4 indicate cases such as casting was impossible and following steps were cancelled due to occurrence of large crack in the middle of the forging step.

The forged materials Nos. 33-67 were evaluated in terms of mechanical strength (mechanical properties) including tensile strength, 0.2% proof stress, and elongation, as well as the area ratio (in %) of the <111> texture in a cross section parallel to the extrusion direction in the same condition as explained in [1] ([0068]-[0079]). These results are shown in Table 5. Diagonally lined sections in Table 5 indicate examples for which the measurements of the strength and the texture analyses were not carried out because of various reasons such as the casting was impossible or occurrence of large crack in the middle of the extrusion and forging steps.

TABLE 3

| | Casting step | Homogenizing heat treatment step | | | The first heating step | Extrusion step | | | The second heating step | |
|---|---|---|---|---|---|---|---|---|---|---|
| Forged Material No. | Casting temperature (° C.) | Temperature (° C.) | Treatment time (hr) | Cooling rate (° C./min) | Heating temperature (° C.) | Extrusion temperature (° C.) | Extrusion ratio | Extrusion rate (m/min) | Heating temperature (° C.) | Heating time (hr) |
| 33 | 700 | 560 | 4 | 1.5 | 540 | 500 | 15 | 3 | 540 | 1.0 |
| 34 | 720 | 540 | 8 | 100.0 | 500 | 480 | 6 | 6 | 500 | 1.5 |
| 35 | 720 | 540 | 12 | 1.5 | 540 | 540 | 20 | 1 | 540 | 2.0 |
| 36 | 720 | 560 | 3 | 1.0 | 480 | 460 | 15 | 12 | 540 | 1.0 |
| 37 | 720 | 540 | 8 | 1.5 | 520 | 500 | 15 | 5 | 560 | 0.75 |
| 38 | 780 | 500 | 12 | 1.5 | 500 | 480 | 15 | 10 | 500 | 1.5 |
| 39 | 720 | 450 | 8 | 1.5 | 520 | 500 | 15 | 5 | 540 | 2.0 |
| 40 | 720 | 420 | 8 | 1.5 | 520 | 500 | 15 | 5 | 540 | 2.0 |
| 41 | 720 | 580 | 8 | 1.5 | 520 | 500 | 15 | 5 | 540 | 2.0 |
| 42 | 720 | 540 | 1 | 1.5 | 520 | 500 | 15 | 5 | 540 | 2.0 |
| 43 | 720 | 540 | 8 | 0.3 | 520 | 500 | 15 | 5 | 540 | 2.0 |
| 44 | 720 | 540 | 8 | 0.1 | 520 | 500 | 15 | 5 | 540 | 2.0 |
| 45 | 720 | 540 | 8 | 1.5 | 580 | 500 | 15 | 5 | 540 | 2.0 |
| 46 | 720 | 540 | 8 | 1.5 | 430 | 425 | 15 | 5 | 540 | 2.0 |
| 47 | 720 | 540 | 8 | 1.5 | 565 | 560 | 15 | 5 | | |
| 48 | 720 | 540 | 8 | 1.5 | 520 | 420 | 15 | 5 | 540 | 2.0 |
| 49 | 720 | 540 | 8 | 1.5 | 520 | 500 | 30 | 5 | 540 | 2.0 |
| 50 | 720 | 540 | 8 | 1.5 | 520 | 500 | 4 | 5 | 540 | 2.0 |
| 51 | 720 | 540 | 8 | 1.5 | 520 | 500 | 15 | 20 | 540 | 2.0 |
| 52 | 720 | 540 | 8 | 1.5 | 520 | 500 | 15 | 0.5 | 540 | 2.0 |
| 53 | 720 | 540 | 8 | 1.5 | 520 | 500 | 15 | 5 | 450 | 2.0 |
| 54 | 720 | 540 | 8 | 1.5 | 520 | 500 | 15 | 5 | 580 | 2.0 |
| 55 | 720 | 540 | 8 | 1.5 | 520 | 500 | 15 | 5 | 520 | 0.5 |
| 56 | 720 | 540 | 8 | 1.5 | 520 | 500 | 15 | 5 | 500 | 2.0 |
| 57 | 720 | 540 | 8 | 1.5 | 520 | 500 | 15 | 5 | 580 | 2.0 |
| 58 | 720 | 540 | 8 | 1.5 | 520 | 500 | 15 | 5 | 520 | 2.0 |
| 59 | 720 | 540 | 8 | 1.5 | 520 | 500 | 15 | 5 | 520 | 2.0 |
| 60 | 720 | 540 | 8 | 1.5 | 520 | 500 | 15 | 5 | 520 | 1.5 |
| 61 | 720 | 540 | 8 | 1.5 | 520 | 500 | 15 | 5 | 520 | 1.5 |
| 62 | 720 | 540 | 8 | 1.5 | 520 | 500 | 15 | 5 | 520 | 2.0 |
| 63 | 720 | 540 | 8 | 1.5 | 520 | 500 | 15 | 5 | 520 | 2.0 |
| 64 | 720 | 540 | 8 | 1.5 | 520 | 500 | 15 | 5 | 520 | 2.0 |
| 65 | 720 | 540 | 8 | 1.5 | 520 | 500 | 15 | 5 | 520 | 2.0 |
| 66 | 720 | 540 | 8 | 1.5 | 520 | 500 | 15 | 5 | 520 | 2.0 |
| 67 | 720 | 540 | 8 | 1.5 | 520 | 500 | 15 | 5 | 520 | 2.0 |

TABLE 4

| Forged Material No. | Forging step: Start temperature (° C.) | Forging step: Finish temperature (° C.) | Forging step: Maximum equivalent plastic strain ε | Solution heat treatment: Temperature (° C.) | Solution heat treatment: Treatment time (hr) | Quenching step Temperature (° C.) | Artificial aging treatment step: Temperature (° C.) | Artificial aging treatment step: Treatment time (hr) |
|---|---|---|---|---|---|---|---|---|
| 33 | 500 | 445 | 1.5 | 555 | 4 | 45 | 200 | 3 |
| 34 | 480 | 425 | 2.5 | 540 | 8 | 60 | 175 | 8 |
| 35 | 500 | 445 | 3.0 | 540 | 8 | 60 | 175 | 8 |
| 36 | 540 | 470 | 1.0 | 560 | 2 | 60 | 140 | 12 |
| 37 | 560 | 475 | 2.0 | 500 | 6 | 40 | 180 | 5 |
| 38 | 450 | 420 | 1.5 | 520 | 4 | 70 | 180 | 5 |
| 39 | 500 | 445 | 1.0 | 540 | 4 | 60 | 175 | 8 |
| 40 | 500 | 445 | 1.0 | 540 | 4 | 60 | 175 | 8 |
| 41 | 500 | 445 | 1.0 | 540 | 4 | 60 | 175 | 8 |
| 42 | 500 | 445 | 1.0 | 540 | 4 | 60 | 175 | 8 |
| 43 | 500 | 445 | 1.0 | 540 | 4 | 60 | 175 | 8 |
| 44 | 500 | 445 | 1.0 | 540 | 4 | 60 | 175 | 8 |
| 45 | 500 | 445 | 1.0 | 540 | 4 | 60 | 175 | 8 |
| 46 | 500 | 445 | 1.0 | 540 | 4 | 60 | 175 | 8 |
| 47 | | | | | | | | |
| 48 | 500 | 445 | 1.0 | 540 | 4 | 60 | 175 | 8 |
| 49 | 500 | 445 | 1.0 | 540 | 4 | 60 | 175 | 8 |
| 50 | 500 | 445 | 1.0 | 540 | 4 | 60 | 175 | 8 |
| 51 | 500 | 445 | 1.0 | 540 | 4 | 60 | 175 | 8 |
| 52 | 500 | 445 | 1.0 | 540 | 4 | 60 | 175 | 8 |
| 53 | 450 | 445 | 1.0 | 540 | 4 | 60 | 175 | 8 |
| 54 | 500 | 445 | 1.0 | 540 | 4 | 60 | 175 | 8 |
| 55 | 500 | 445 | 1.0 | 540 | 4 | 60 | 175 | 8 |
| 56 | 430 | 395 | 1.0 | 540 | 4 | 60 | 175 | 8 |
| 57 | 580 | 485 | 1.0 | | | | | |
| 58 | 500 | 445 | 4.0 | 540 | 4 | 60 | 175 | 8 |
| 59 | 500 | 445 | 1.0 | 450 | 4 | 60 | 175 | 8 |
| 60 | 500 | 445 | 1.0 | 600 | 4 | 60 | 175 | 8 |
| 61 | 500 | 445 | 1.0 | 540 | 1 | 60 | 175 | 8 |
| 62 | 500 | 445 | 1.0 | 540 | 12 | 60 | 175 | 8 |
| 63 | 500 | 445 | 1.0 | 540 | 4 | 90 | 175 | 8 |
| 64 | 500 | 445 | 1.0 | 540 | 4 | 60 | 120 | 8 |
| 65 | 500 | 445 | 1.0 | 540 | 4 | 60 | 250 | 8 |
| 66 | 500 | 445 | 1.0 | 540 | 4 | 60 | 175 | 2 |
| 67 | 500 | 445 | 1.0 | 540 | 4 | 60 | 175 | 24 |

TABLE 5

| Forged Material No. | Mechanical properties: Tensile strength (MPa) | Mechanical properties: 0.2% proof stress (MPa) | Mechanical properties: Elongation (%) | Texture: <111> texture (%) | Texture: Depth of recrystallization T (mm) | Remarks |
|---|---|---|---|---|---|---|
| 33 | 440 | 422 | 11.9 | 90 | 1 or less | |
| 34 | 412 | 393 | 13.1 | 65 | 2 | |
| 35 | 404 | 392 | 16.3 | 65 | 3 | |
| 36 | 424 | 406 | 15.3 | 80 | 1 or less | |
| 37 | 437 | 415 | 14.4 | 85 | 1 or less | |
| 38 | 416 | 398 | 16.8 | 70 | 1 or less | |
| 39 | 400 | 380 | 18.7 | 80 | 1 or less | |
| 40 | 388 | 365 | 10.4 | 75 | 1 or less | |
| 41 | 358 | 327 | 19.3 | 35 | More than 10 | |
| 42 | 401 | 393 | 9.8 | 75 | 1 or less | |
| 43 | 370 | 343 | 18.2 | 35 | More than 10 | |
| 44 | 359 | 338 | 20.8 | 15 | More than 10 | |
| 45 | 399 | 378 | 14.4 | 60 | 3 | |
| 46 | 357 | 336 | 18.2 | 15 | More than 10 | |
| 47 | | | | | | Large crack occurred in extrusion step. |
| 48 | 330 | 302 | 25.4 | 10 | More than 10 | |
| 49 | 391 | 351 | 16.7 | 30 | 7 | |
| 50 | 370 | 341 | 15.3 | 35 | 1 or less | |
| 51 | 399 | 377 | 14.7 | 20 | More than 10 | |
| 52 | 360 | 321 | 24.1 | 5 | More than 10 | |
| 53 | 380 | 358 | 15.9 | 20 | 6 | |
| 54 | 394 | 370 | 18.4 | 25 | 5 | |
| 55 | 327 | 302 | 22.3 | 15 | More than 10 | |
| 56 | 329 | 308 | 23.6 | 5 | More than 10 | |

TABLE 5-continued

| Forged Material No. | Mechanical properties: Tensile strength (MPa) | 0.2% proof stress (MPa) | Elongation (%) | Texture: <111> texture (%) | Depth of recrystallization T (mm) | Remarks |
|---|---|---|---|---|---|---|
| 57 | | | | | | Large crack occurred in the forging step. |
| 58 | 324 | 300 | 24.8 | 5 | More than 10 | |
| 59 | 394 | 390 | 6.5 | 85 | 1 or less | |
| 60 | 322 | 304 | 33.0 | 5 | More than 10 | |
| 61 | 374 | 351 | 17.1 | 80 | 1 or less | |
| 62 | 398 | 385 | 16.9 | 35 | 8 | |
| 63 | 373 | 350 | 14.2 | 75 | 1 | |
| 64 | 370 | 330 | 16.6 | 85 | 1 or less | |
| 65 | 354 | 350 | 12.7 | 85 | 1 or less | |
| 66 | 389 | 359 | 19.4 | 85 | 1 or less | |
| 67 | 377 | 363 | 9.4 | 85 | 1 or less | |

As shown in Tables 3 to 5, forged materials Nos. 33-39 are excellent in terms of mechanical strength such as tensile strength, 0.2% proof stress, and elongation, satisfying the requirements of the present invention. Namely, the enhancement of mechanical strength of forged material has been achieved. Each of the forged materials is also excellent in terms of area ratio of the <111> texture in a cross section parallel to the extrusion direction. In particular, the test materials which satisfy the requirements in terms of the alloy composition for the present invention as well as have the area ratio of the <111> texture in a cross section parallel to the extrusion direction of 60% or more, showed enhanced mechanical strength of 0.2% proof stress of 380 MPa or more, preferably 390 MPa or more, and more preferably 400 MPa or more. Each of such materials possessed tensile strength of 400 MPa or more, and elongation of 10.0% or more as well.

Forged materials Nos. 40-67, on the other hand, did not satisfy at least one of the required manufacturing conditions according to the present invention. Therefore, they are inferior in terms of mechanical strength such as tensile strength, 0.2% proof stress, and elongation as shown in Table 5. Further, some of them did not reach the standard of area ratio of the <111> texture in a cross section parallel to the extrusion direction.

In the foregoing, the present invention has been described by means of the preferred embodiments and Examples. The present invention, however, is not limited to such preferred embodiments and Examples, and it may be improved or modified without deviating from the spirit of the present invention, and such improvement or modification are within the scope of the present invention.

This application claims priority from Japanese Patent Applications Nos. 2013-74378 and 2013-255380 filed on Mar. 29, 2013 and Dec. 10, 2013, respectively, the disclosure of which is incorporated herein by reference in its entirety.

The invention claimed is:

1. An aluminum alloy forged material, manufactured by a process comprising extrusion having an extrusion direction and forging, the aluminum alloy forged material comprising:

Si: 0.7-1.5 mass %;

Fe: 0.5 mass % or less;

Cu: 0.1-0.6 mass %;

Mg: 0.6-1.2 mass %;

Ti: 0.01-0.1 mass %; and

Mn: 0.25-1.0 mass %;

at least one element selected from the group consisting of Cr: 0.1-0.4 mass % and Zr: 0.01-0.2 mass %;

Zn: 0.05 mass % or less;

a hydrogen amount: 0.25 ml/100 g-Al or less; and the remainder being Al and inevitable impurities, wherein the area ratio of <111> texture is 60% or more in a cross section parallel to the extrusion direction, the aluminum alloy forged material having a tensile strength of 400 MPa or more, and an elongation of 10.0% or more.

2. The aluminum alloy forged material according to claim 1, wherein the region where the recrystallized grains exist is 5 mm or less as measured from the surface of the forged material.

3. The aluminum alloy forged material according to claim 1, wherein recrystallized grains exist in a region that is 2 mm or less as measured from the surface of the forged material.

4. The aluminum alloy forged material according to claim 1, wherein recrystallized grains exist in a region that is 1 mm or less as measured from the surface of the forged material.

5. The aluminum alloy forged material according to claim 1, wherein Fe is present in an amount of 0.3 mass % or less; and Cu is present in an amount of 0.3-0.6 mass %.

6. The aluminum alloy forged material according to claim 1, which is made by a method comprising in the following order:

homogenizing heat treating an ingot at 450-560° C. for 3-12 hours, and to cooling to 300° C. or below at a rate of 0.5° C./min or more, a first heating the ingot having been subjected to the homogenizing heat treatment at 450-540° C., extruding the ingot having been subjected to the first heating at extrusion temperature of 450-540° C., an extrusion ratio of 6-25, and an extrusion rate of 1-15 m/minute to yield an extrusion product, a second heating the extrusion product at 500-560° C. for 0.75 hour or more, forging the product having been subject to the second heating, the forging conducted at 450-560° C. of the forging start temperature and 420° C. or above of the forging finish temperature to obtain a forged material of a predetermined shape with an maximum equivalent plastic strain of 3 or less, solution heat treating the forged material at 480-560° C. for 2-8 hours, quenching the solution heat treated forged material at 70° C. or below, and artificial aging the quenched material at 140-200° C. for 3-12 hours.

7. A method for manufacturing an aluminum alloy forged material of claim 1 from an ingot obtained by melting and casting an aluminum alloy comprising:

Si: 0.7-1.5 mass %;

Fe: 0.5 mass % or less;

Cu: 0.1-0.6 mass %;

Mg: 0.6-1.2 mass %;

Ti: 0.01-0.1 mass %; and

Mn: 0.25-1.0 mass %;

at least one element selected from the group consisting of Cr: 0.1-0.4 mass % and Zr: 0.01-0.2 mass %;

Zn: 0.05 mass % or less;

a hydrogen amount: 0.25 ml/100 g-Al or less; and the remainder being Al and inevitable impurities, wherein the manufacturing method comprises in the following order:

homogenizing heat treating the ingot at 450-560° C. for 3-12 hours, and to cooling to 300° C. or below at a rate of 0.5° C./min or more, a first heating the ingot having been subjected to the homogenizing heat treatment at 450-540° C., extruding the ingot having been subjected to the first heating at extrusion temperature of 450-540° C., an extrusion ratio of 6-25, and an extrusion rate of 1-15 m/minute to yield an extrusion product, a second heating the extrusion product at 500-560° C. for 0.75 hour or more, forging the product having been subject to the second heating, the forging conducted at 450-560° C. of the forging start temperature and 420° C. or above of the forging finish temperature to obtain a forged material of a predetermined shape with an maximum equivalent plastic strain of 3 or less, solution heat treating the forged material at 480-560° C. for 2-8 hours, quenching the solution heat treated forged material at 70° C. or below, and artificial aging the quenched material at 140-200° C. for 3-12 hours.

8. The method for manufacturing the aluminum alloy forged material for an automobile according to claim 7, wherein the maximum equivalent plastic strain is 1.5 or less in the forging step.

* * * * *